United States Patent [19]

WU

[11] Patent Number: 4,480,891

[45] Date of Patent: Nov. 6, 1984

[54] ELECTRICAL PLUG AND SOCKET HAVING REPLACEABLE OVERCURRENT-PROTECTION DEVICE WITH SAFETY LATCH MEANS

[76] Inventor: Jeng-Shyong WU, No. 133 Tungshing Rd., Toufun, Maulii, Taiwan

[21] Appl. No.: 302,062

[22] Filed: Sep. 14, 1981

[51] Int. Cl.[3] ..... H01R 13/68

[52] U.S. Cl. ..... 339/147 P; 337/198

[58] Field of Search ..... 339/147 R, 147 P; 337/197, 198, 201

[56] References Cited

U.S. PATENT DOCUMENTS 4,274,698 6/1981 Ahroni ..... 339/147 P 4,309,068 1/1982 Ahroni ..... 339/147 P

*Primary Examiner*—Eugene F. Desmond

*Attorney, Agent, or Firm*—Kalish & Gilster

[57] ABSTRACT

An electrical plug, of male or female construction, provided with a relatively enlarged opening between the main conductors of the plug such as outwardly projecting prongs or inwardly disposed blades, for removal from and insertion therein of an overcurrent-protection device and cooperating safety latch means. The direction in which said device and latch means are removed from the plug is the same as the direction in which the plug is engaged to its mating electrical device so that such removal and replacement may be effected only if the plug or socket is not in union with its mating electrical device. The safety latch means and the associated overcurrent-protection device or component are so cooperatively constructed that when disposed within said plug body a compressive, deforming force is exerted upon said overcurrent-protection device so as to assure of proper circuit-establishing relationship of the various terminals and contacts within the plug to the prongs or blades thereby bringing about conductive relationship of a reliability heretofore unknown. The plug of the present invention is easily operated and safe, being specially designed for unskilled individuals while constituting an advantageous electrical connection between it and its associated mating device.

19 Claims, 54 Drawing Figures

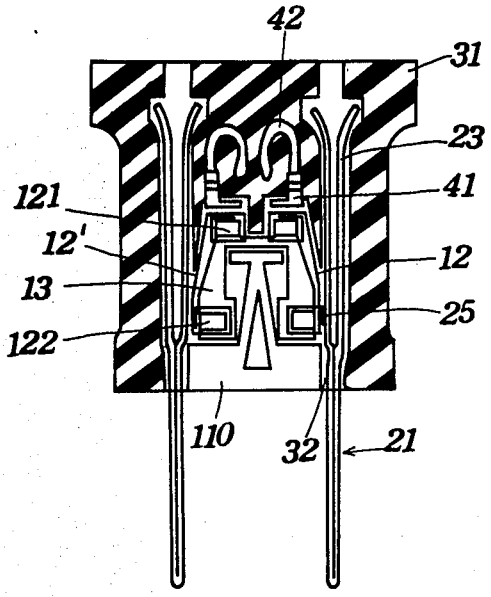
FIG.2A
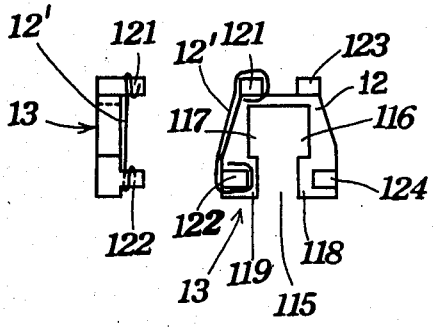
FIG.2C
FIG.2B
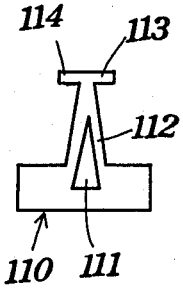
FIG.2D

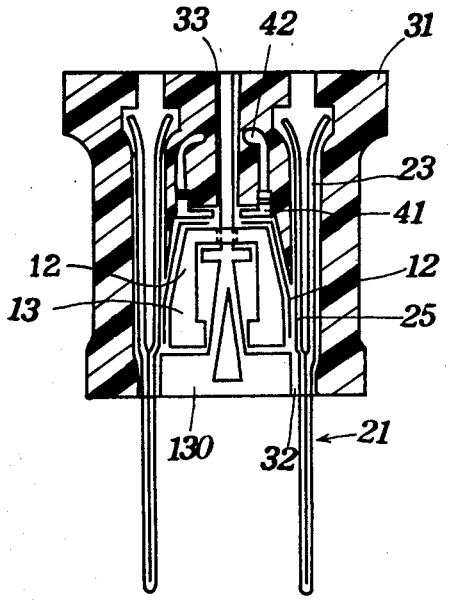
FIG.3A
FIG.3C
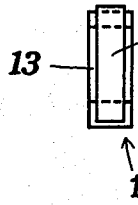
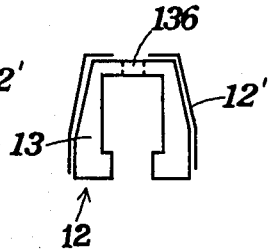
FIG.3B
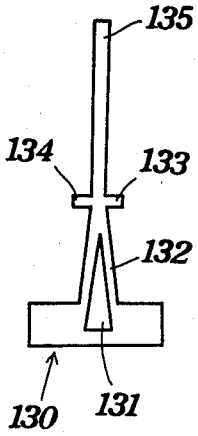
FIG.3D

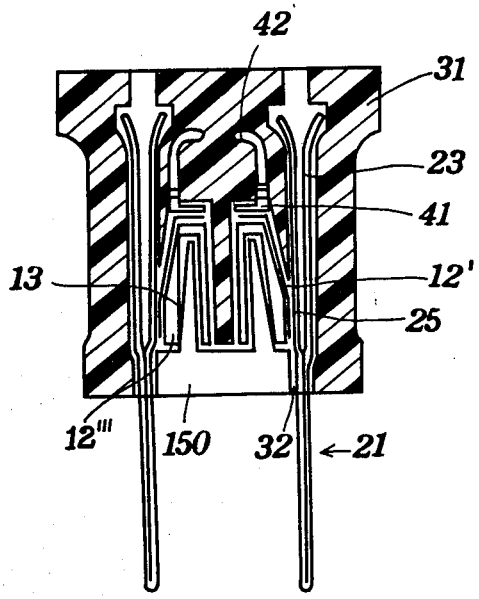
FIG.5A
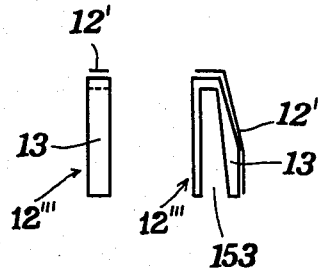
FIG.5C
FIG.5B
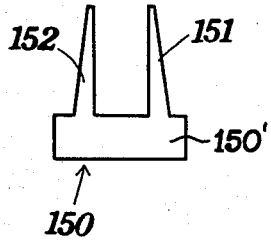
FIG.5D

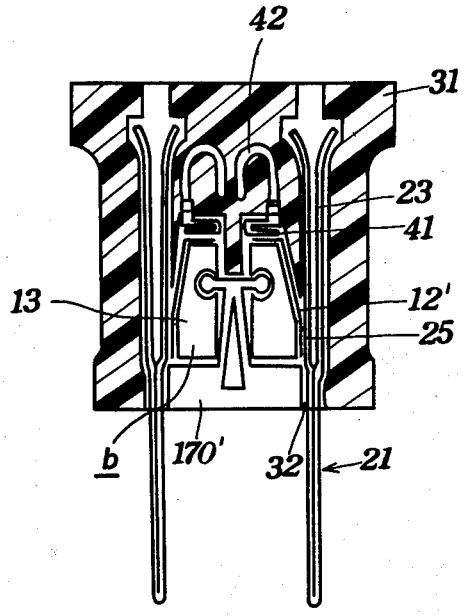
FIG.7A
FIG.7C
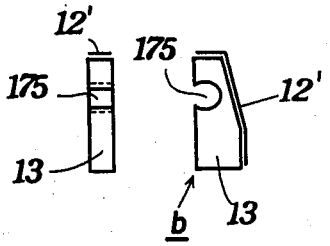
FIG.7B
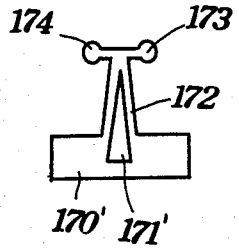
FIG.7D

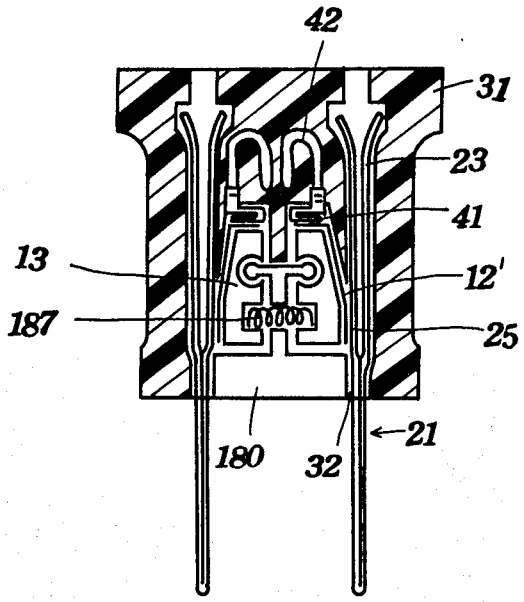
FIG.8A
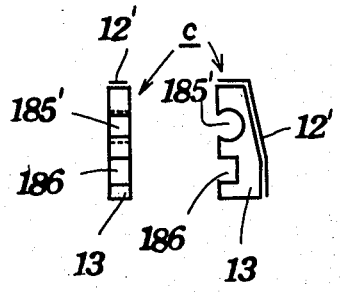
FIG.8C
FIG.8B
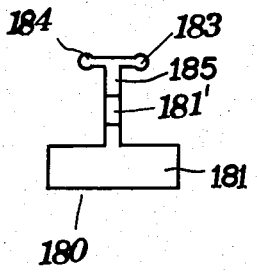
FIG.8D

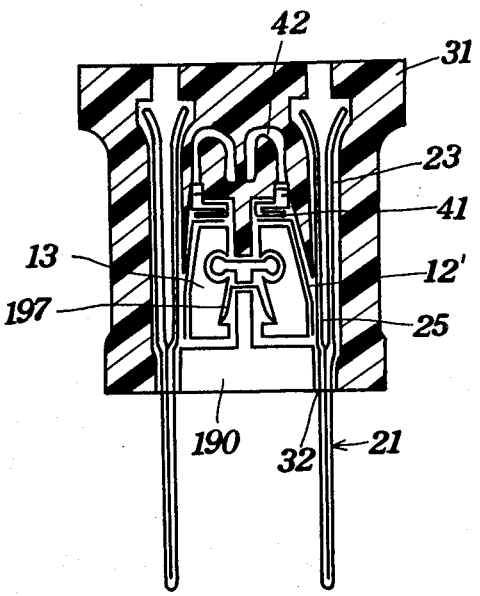
FIG.9A
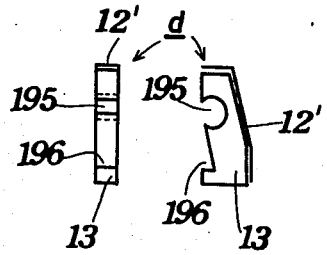
FIG.9C
FIG.9B
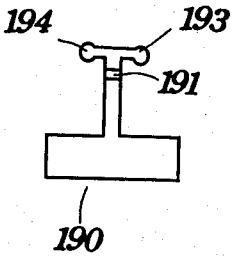
FIG.9D

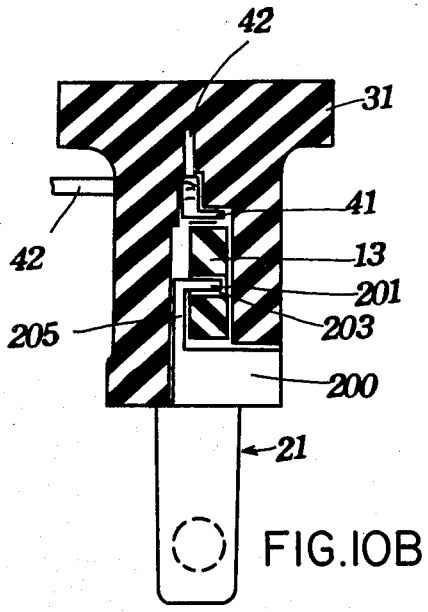
FIG.10B
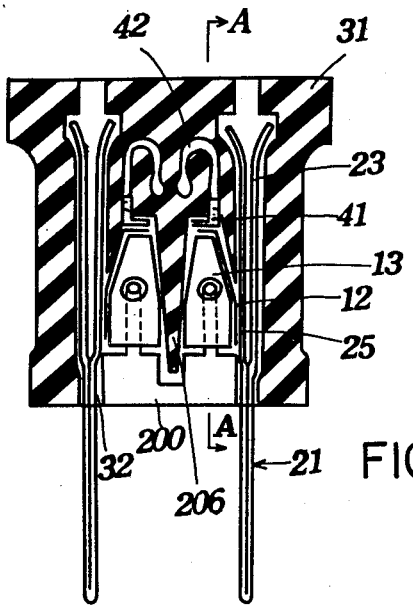
FIG.10A
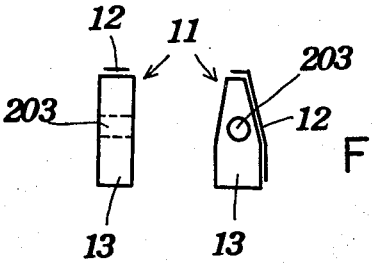
FIG.10D
FIG.10C
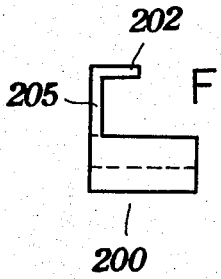
FIG.10F
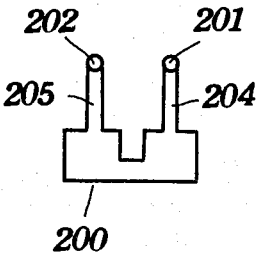
FIG.10E 213
12'
210
216

213
212
12'
12'
211
210
216

215
33
214
42
31
23
41
12'
24
210
32
21

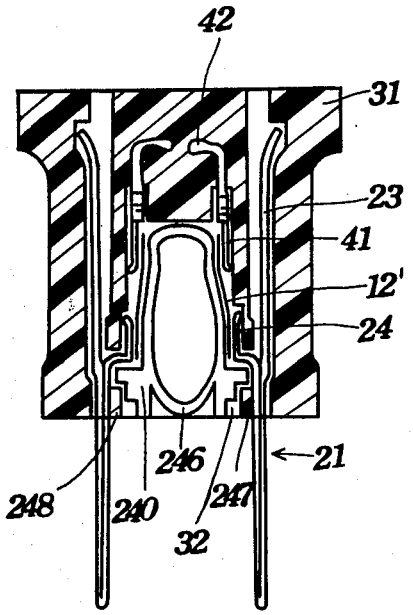
FIG.14A
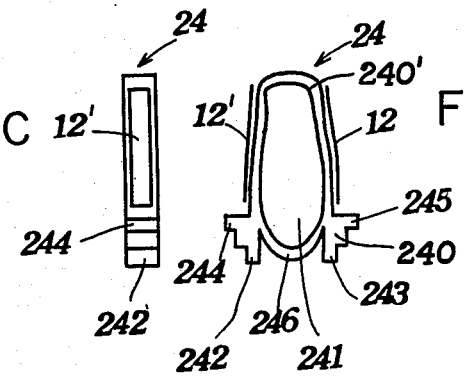
FIG.14C
FIG.14B

ELECTRICAL PLUG AND SOCKET HAVING REPLACEABLE OVERCURRENT-PROTECTION DEVICE WITH SAFETY LATCH MEANS

FIELD OF THE INVENTION

This invention relates in general to electrical plugs and sockets, and more particularly, to such plugs and sockets adapted to receive replaceable overcurrent-protection devices therefor having associated safety latch members.

BACKGROUND OF THE INVENTION AND DESCRIPTION OF THE PRIOR ART

Electrical plugs, both of the male and female type, equipped with replaceable overcurrent-protection devices and the electrical components associated therewith are designed for disposition of the devices intermediate the normal copper prongs of the male plug or the contact blades of the female plug and the conductive extensions of the same for connnecting the latter with the usual electrical equipment. The functioning of such devices are well-known in the art and applicant's copending application Ser. No. 121,324 discloses an imporvement of such devices; said application being incorporated in this application by reference.

Since the present invention is readily useful with both male and female electrical plugs, it is to be understood that hereinbelow the term "plug" shall be construed as referring to both types since in the former the conductive components comprise normally outwardly projecting prongs whereas in the latter there are provided internally disposed copper blades for union with the prongs of the associated electrical element. Thus the adaptability of the present invention to either type of plug is readily apparent so that the stated definition of the word "plug" for purposes of this application is fully warranted. In a conventional electrical plug the body thereof is normally formed of insulating material such as a plastic, as PVC, PP, PE, or the like, which material is customarily subjected to expansion, contraction, or other deformation resulting from temperature changes occuring during manufacture or in usage. Additionally, such plugs will be deformed or distorted as a result of externally applied compression or tension forces resulting in adversely affecting the electrical connection with the development of various problems such as inadequate contact performance; non-conductive phenomena; or imperfect conductivity which result in temperature rise with attendant sparking or burning. An effective plug should be constructed to satisfy the usual various types of rigid pre-release tests, such as, for instance, temperature rise tests, overload anti-sparking tests, high current short-circuiting tests, etc. Thus the potential for the development of such problems must be taken into consideration during plug design since without satisfying these tests any plugs would necessarily represent a source of serious danger.

SUMMARY OF THE INVENTION

The object of this invention is to provide an electrical plug adapated to receive a replaceable overcurrent-protection device which thus obviates the development of problems and defects of the type heretofore encountered by prior art constructions as above discussed.

According to the present invention, there is provided a safety latch member adapted to be inserted into the body of the plug for suitable engagement to an independently but cooperatively constructed overcurrent-protection device, or a safety latch member which integrally carries an overcurrent-protection device. When the latch member is thus fittedly received within a suitable opening in the plug body, the same being so constructed as by various means, such as through compression deformation, lever action, spring bias, or rotative action to cause the overcurrent-protection device or component, as the case may be, to be displaced so as to create a force for assuring positive and reliable contact between said device and the electrical connection elements, such as the connection contacts, conductor terminals, prongs and internal blades with the related branch connection contacts, etc., for the purpose of assuring of urging reliable and excellent contact performance.

The force bringing about compression deformation is achieved by providing the latch member with any number of one of the following structural features such as an opening, flanges, tapering contour, or the like, for interacting with the overcurrent-protection device. Thus, for instance, a lever action may be achieved by providing the latch member with a supporting leg serving as a fulcrum to adapt the overcurrent-protection device or component for free movement. A force developed by spring bias may be accomplished by providing a spring such as, for instance, of helical or leaf form, to apply through the inherent bias a force upon the overcurrent-protection device or component to force same into conductive relationship with the adjacent cooperative elements. The rotative action is developed by so constructing the safety latch member and locating fuse elements spacedly thereabout so that by appropriate orientation as through rotation the circuit desired will be established.

BRIEF DESCRIPTION OF THE DRAWINGS

FIG. 2 comprises FIG. 2A which is a vertical transverse sectional view of an electrical plug embodying a second form of overcurrent-protection device constructed in accordance with and embodying the present invention and the safety latch member; FIGS. 2B and 2C are schematic front and side elevational views, respectively, of the overcurrent-protection device shown in FIG. 2A; and FIG. 2D is a front elevational view of the safety latch member.

FIG. 3 comprises FIG. 3A which is a vertical transverse sectional view of an electrical plug embodying a third form of overcurrent-protection device and a second form of safety latch member constructed in accordance with and embodying the present invention; FIGS. 3B and 3C are schematic front and side elevational views, respectively, of the aforesaid overcurrent-protection device; and FIG. 3D is a schematic front elevational view of the aforesaid safety latch member.

FIG. 5 comprises FIG. 5A which is a vertical transverse sectional view of an electrical plug embodying a fifth form of overcurrent-protection device and fourth form of safety latch member constructed in accordance with and embodying the present invention; and FIGS. 5B and 5C are schematic front and side elevational views, respectively, of the aforesaid overcurrent-protection device; and FIG. 5D is a schematic front elevational view of the aforesaid safety latch member.

FIG. 7 comprises FIG. 7A which is a vertical transverse sectional view of an electrical plug having a seventh form of overcurrent-protection device and fifth form of safety latch member constructed in accordance with and embodying the present invention; FIGS. 7B and 7C are schematic front and side elevational views, respectively, of the aforesaid overcurrent-protection device; and FIG. 7D is a schematic front elevational view of the aforesaid safety latch member.

FIG. 8 comprises FIG. 8A which is a vertical transverse sectional view of an electrical plug having an eighth form of overcurrent-protection device and sixth form of safety latch member constructed in accordance with and embodying the present invention; FIGS. 8B and 8C are schematic front and side elevational views, respectively, of the aforesaid overcurrent-protection device; and FIG. 8D is a schematic front elevational view of the aforesaid safety latch member.

FIG. 9 comprises FIG. 9A which is a vertical transverse sectional view of an electrical plug having a ninth form of overcurrent-protection device and seventh form of safety latch member constructed in accordance with and embodying the present invention; FIGS. 9B and 9C are schematic front and side elevational views respectively of the aforesaid overcurrent-protection device; and FIG. 9D is a schematic front elevational view of the aforesaid safety latch member.

FIG. 10 comprises FIG. 10A which is a vertical transverse sectional view of an electrical plug having a tenth form of overcurrent-protection device and eighth form of safety latch member constructed in accordance with and embodying the present invention; FIG. 10 B is a vertical transverse sectional view taken on the line A—A of FIG. 10A; FIGS. 10C and 10D are schematic front and side elevational views, respectively, of the aforesaid overcurrent-protection device; and FIGS. 10E and 10F are schematic front and side elevational views, respectively, of the aforesaid safety latch member.

FIG. 11 comprises FIG. 11A which is a vertical transverse sectional view of an electrical plug having a ninth form of safety latch member constructed in accordance with and embodying the present invention.

FIG. 14 is a transverse sectional view of an electrical plug having a further form of an overcurrent-protection device and a twelfth form of safety latch member constructed in accordance with and embodying the present invention; and FIGS. 14B and 14C are schematic front and side elevational views, respectively, of the aforesaid safety latch member.

DESCRIPTION OF THE PRACTICAL EMBODIMENTS

Figure 1A:
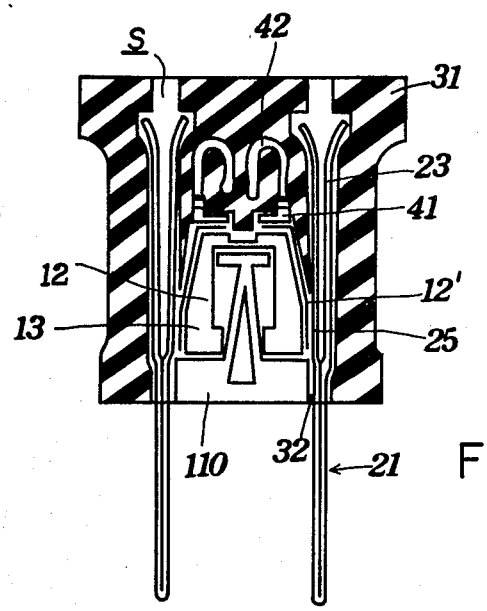
FIG. 1 comprises FIG. 1A which is a vertical transverse sectional view of an electrical plug embodying an overcurrent-protection device and safety latch member constructed in accordance with and embodying the present invention.
FIG. 1B is a schematic front elevational view of the overcurrent-protection device.
FIG. 1C is a schematic front elevational view of the safety latch member.
Figure 1B:
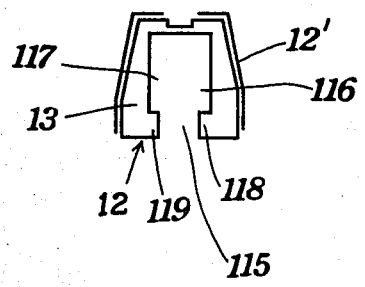

Referring now by reference characters to the drawings which illustrate practical embodiments of the present invention, in FIG. 1 31 indicates an electrical plug body having a pair of outwardly, and, normally considered, forwardly projecting conductive prongs or blades 21. Although plug body 31 is thus shown as of male character, it is to be understood that said plug may be of female character having a pair of socket-like openings (not shown) internally provided with conductive blades (not shown) for establishing circuit-forming relationship with the blades of a cooperative component. As will be shown, the present invention is equally effective with either type of plug and therefore, the restriction of the description to plugs of the said male type is solely for purposes of exposition and not limitation.

Plug body 31 is shown herein as being of both male and female character by being provided with a pair of add-on plug slots s adapted to receive the prongs of a section plug (not shown) within the respective base conductive portions 23 of the prong members 21; all as is well-known in the art. But it is recognized that it is unnecessary for plug 31 to be of such dual character for the purposes of the present invention.

Basically, plug 31, when in use, will complete a circuit through prongs 21, and internal portions 25 thereof which are in conductive engagement with an overcurrent-protection device 12 thence through the related lead terminals 41 and the insulated conductors 42 associated with said terminals 41. It is to be noted that overcurrent-protection device 12 may be used in both poles of the plug 31 or in only one pole; and for the sake of simplicity, only one pole of plug 31 is indicated with reference numerals as described herein. Overcurrent-protection device 12 may include a base of insulating material and a fuse element of filament shape, strip shape, or tube shape fixed onto the base by any suitable fastening or securing means such as by plating, clipping, interlocking, coating, and the like. Lead terminals 41 may also be of various shapes, sizes and structural forms, if desired. As will be further developed hereinbelow, the insulating plug body may be designed for accommodating the various forms of safety latch members embodying the present invention as well as for the different configurations and structures of overcurrent-protection devices. Preferrably, the basis of overcurrent-protection devices of the present invention and the associated safety latch members are constructed of an insulating material which possesses a desired resiliency in order to enhance electrical connection therebetween.

Figure 1C:
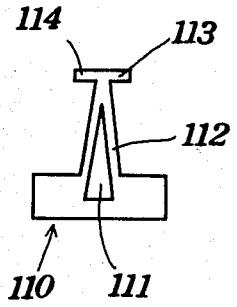
Figure 4A:
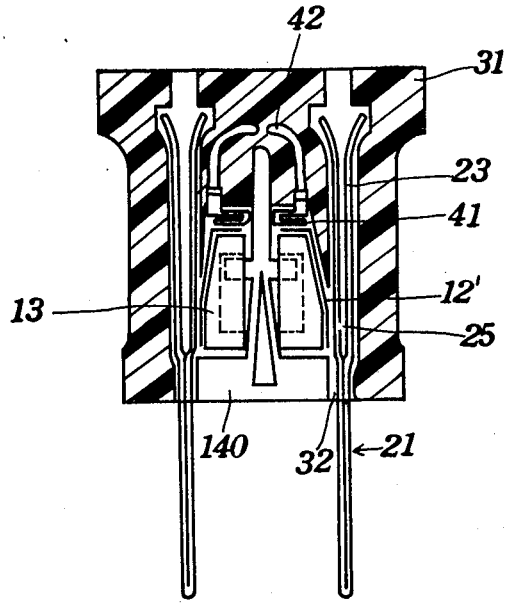
FIG. 4 comprises FIG. 4A which is a vertical transverse sectional view of an electrical plug embodying a fourth form of an overcurrent-protection device and third form of a safety latch member constructed in accordance with and embodying the present invention.
FIGS. 4B and 4C are schematic front and side elevational views, respectively, of the said overcurrent-protection device.
FIGS. 4D and 4E are schematic front and side elevational views, respectively, of a modified form of the said overcurrent-protection device.
FIG. 4F is a front elevational view of the aforesaid safety latch member.
Figure 4C:
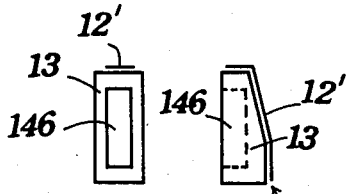
Figure 4B:
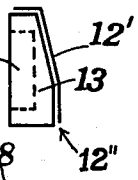
Figure 4E:
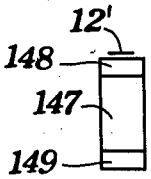
Figure 4D:
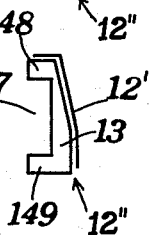
Figure 4F:
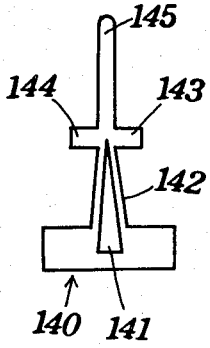

Turning now more particularly to FIG. 1C of FIG. 1 which discloses the initial embodiment of the safety latch member of the present invention; the same being indicated 110 and includes a central tapered supporting leg 112 projecting upwardly from the base portion; said leg having a central opening or hollow 111 and at its base-remote end said leg is integral with a pair of axially normal flanges 113, 114 which project in opposite directions. Overcurrent-protection device 12 includes a generally U-shaped base member 13 which opens downwardly and fuse elements 12' secured to opposite outer face portions of said base member 13 as by plating, cementing, coating, etc. Base member 13 of overcurrent-protection device 12 is provided internally with opposed recesses 116, 117 and outer end flanges 118, 119 which mutually terminate spacedly to define an opening 115 leading into the recessed portion. Safety latch member 110 is fitted within overcurrent-protection device 12 with flanges 113, 114 received within the inner portions of recesses 116, 117, respectively; the said tapered leg 112 extending through opening 115 into the interior of overcurrent-protection device 12. As may best be seen in FIG. 1A, overcurrent-protection device 12 in combination with safety latch member 110 is fitted within the body of plug 31 through an outwardly opening recess 32 between the inner portions of said prongs 21 so that the wider portion of leg 112 will cause outer end flanges 118, 119 of base member 13 to expand or be driven laterally outwardly thereby forcing the related fuse elements 12' to press firmly against the internal portion 25 of the adjacent prong 21. Overcurrent-protection device 12 may be removed after safety latch member 110 has been pulled outwardly to such a position that the narrow or normally inner portion of leg 112 is located in opening 115 with flanges 113, 114 abuttingly engaging upon the upper surfaces of flanges 118, 119 of base member 13 whereupon the laterally outward, expanding force theretofore acting upon base member 112 is terminated. The connection of the normally inner ends of fuse elements 12' with lead terminals 41 may be assured by fixing base member 13 to plug 31 as with a screw or like fastener as will be seen in the embodiment of FIG. 1. Base member 13 of overcurrent-protection device 12 carries two fuse elements 12' so as to provide both poles of plug 31 with overcurrent protection simultaneously.

As is evident from a description of the drawings set forth hereinabove, numerous embodiments of the present invention are set forth herein. In describing the succeeding embodiments, corresponding parts thereof will be indicated by like reference characters for facilitating the description.

Referring now to FIG. 2, it is to be understood that safety latch member 110 and overcurrent-protection device 12 will be of like relationship as the related components of FIG. 1 hereinabove described so that the assembling and disassembling of same will be identical. The primary distinction between the embodiment of FIG. 2 and that of FIG. 1 is that base member 13 of overcurrent-protection device 12 is formed with two pairs of projections, namely a lower pair 122, 124 and an upper pair 121, 123 which extend forwardly from the face of said member 13 and with the ends of fuse elements 12' being respectively wound around a pair of upper and lower projections 121, 122 and 123, 124 for positively attaching the same to overcurrent-protection device 12, as may be seen in FIGS. 2B and 2C.

Referring now to FIG. 3 which illustrates a further embodiment of the present invention, the safety latch member 130 and the overcurrent-protection device 12 are basically the same as those shown in FIG. 1 and are assembled and disassembled in the same fashion. However, the leg 132 of safety latch member 130 embodies an upward extension 135, with horizontal extensions 133, 134 for projection through an opening 135 formed in the inner or upper end of overcurrent-protection device 12 for projection into a complementary opening 33 formed in the central upper portion of plug 31. Such extension 135 thus facilitates dismantlement as well as operative disposition of the safety latch member indicated at 130 in this embodiment.

Referring now to FIG. 4 which shows a still further embodiment of the present invention, safety latch member 140 is fundamentally the same as latch members 110 and 130 hereinabove described except that it possesses an extension 145 which is of reduced length relative to extension 135 of the plug shown in FIG. 3. The overcurrent-protection device of this embodiment which is indicated generally at 12'' is formed of two distinct symmetrical components, as opposed to being an integral unit, with a component thus for each pole of plug 31. Each component 12'' includes a fuse element 12' secured to the related base member 13 as by plating, cementing, coating or the like, and with the respective base member 13 having either a recess 146 closed on its sides (see FIGS. 4B and 4C) or, if desired, a recess, open-sided, 147 (see FIGS. 4D and 4E). Flanges 143, 144 of safety latch leg 140 which correspond to flanges 113, 114 of safety latch member 110 above described are designed for respective fitting within the particular recesses, 146 or 147, as the case may be, and with tapered leg 142 thus serving to provide an outward expanding force upon the base flanges 149 of components 12' in order to promote the desired electrical connection through fuse elements 12'.

Referring now to FIG. 5 which illustrates an additional embodiment of the present invention 150 designates a safety latch member having a base 150' from which project upwardly a pair of spaced apart upstanding tapered support legs 151, 152, a pair of overcurrent-protection devices 12''' is provided for cooperating with each of said latch legs 151, 152 and with said devices 12''' each having an upwardly extending recess 153 for accepting the related latch leg. Said legs 151, 152 thus effect a lateral expansion of the associated overcurrent-protection device 12''' for forcing the related fuse element 12' against the base contact portion 25 of the adjacent prong 21.

Figure 6A:
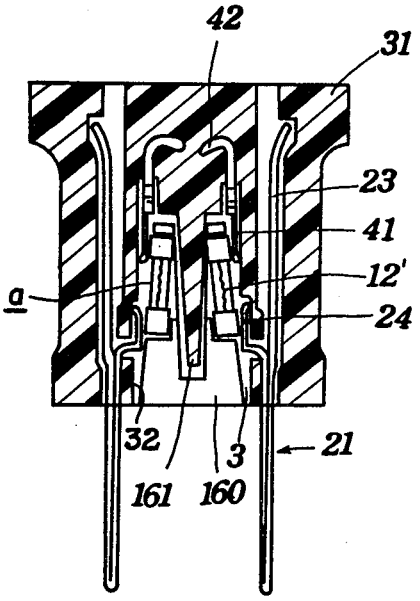
FIG. 6 comprises FIG. 6A which is a vertical transverse sectional view of an electrical plug having a sixth form of overcurrent-protection device constructed in accordance with and embodying the present invention.
FIGS. 6B and 6C are schematic front and side elevational views, respectively, of the aforesaid overcurrent-protection device.
Figure 6C:
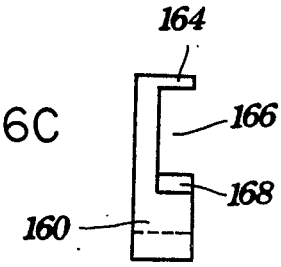
Figure 6B:
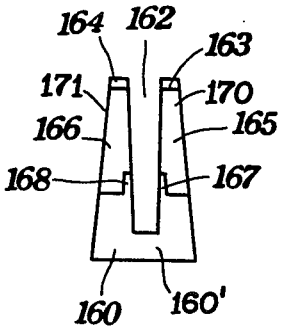

Turning now to FIG. 6 which illustrates a still further embodiment of the present invention, 160 designates a safety latch member which incorporates a base 160' from which a pair of upwardly extending tapering members 170, 171 extend, being separated by an upwardly opening reversely tapered spacing 162. Each leg 170 embodies forwardly opening recesses 165, 166 bounded by upper and lower forwardly extending flanges 163, 167 and 164, 168. Said lower flanges 167, 168 are of reduced width and are formed on the inner portions of related legs 170, 171 spacedly from the normally outer lateral edges thereof. Within central opening 32 of plug 31 there is formed a downwardly extending tapered projection 161 substantially of contour complementary to spacing 162 for relative extension thereinto when latch member 160 is in operative position. Fuse elements 12' of the related overcurrent-protection device as indicated at a are inserted into the associated recesses 165, 166 and maintained therein by the associated flanges 167, 163 and 168, 164. Safety latch member 160 with fuse elements 12' held thereon is fitted into the body of plug 31 through opening 32, with projection 161 being accepted within spacing 132. Said projection 161 provides an expansion force to overcurrent-protection device a causing fuse elements 12' to be brought firmly into circuit-forming relationship with the branch contact 24 of related prong 21 as well as the proximate lead terminal 41. When safety latch 160 is withdrawn the expanding force thus is discontinued and said member 160' and device a can then be easily dismantled.

Referring now to FIG. 7, another form of the present invention is disclosed wherein the safety latch member 170' is of substantially similar construction to latch member 110 shown in FIG. 1 hereinabove except that horizontal flanges 173, 174 which correspond to flanges 113, 114 respectively are provided with generally rounded or spherical ends. The overcurrent-protection device b is of two-part character with each part including a fuse element 12' carried upon the outer surface of a base member 13 each of which on their opposite surface is provided with an inwardly-opening spherical recess 175 contoured for accepting the rounded end of the related flange 173, 174 all as is shown in FIG. 7A. Thus, by such general ball and socket arrangement overcurrent-protection device b can move freely about the end of the related flange. When overcurrent-protection device b with latch member 170' engaged thereon is fitted into the body of plug 31 through opening 32 thereof, the tapered main leg 172 of latch member 170', being resilient will effect an expanding force upon the overcurrent-protection device b forcing the associated fuse elements 12' into current establishing relationship with the branch portions 25 of the related prongs 21.

Referring now to FIG. 8 which illustrates a further embodiment of the present invention; the safety latch member 180 incorporates a base 181 of like character to the latch members hereinabove described from which centrally extends a leg 185 having formed therein a spring-receiving groove 181'. The upper end of leg 185 incorporates a pair of relatively outwardly extending flanges 183, 184 in planar normal relationship to leg 185 and having the ends of such flanges rounded as in the embodiment shown in FIG. 7. Overcurrent-protection device c which is also of two part character is similar to overcurrent-protection device b as shown in the embodiment of FIG. 7 but in addition to including a spherical recess 185' also incorporates a recess or notch 186 for accepting an end portion of a helical spring 187 mounted within groove 181' of leg 185. It will thus be seen that the rounded ends of flanges 183, 184 relate to spherical recesses 185' of overcurrent-protection device c in the same manner as the corresponding elements shown in FIG. 7. When the overcurrent-protection device c and latch member 180 are interengaged the same may then be fitted into the body of plug 31 through opening 32 and therein overcurrent-protection device c will be caused to expand under the bias of spring 187 whereby the associated fuse elements are pressed firmly into conductive relationship with the branch portions 25 of the adjacent prongs 21.

Referring now to FIG. 9 which illustrates another embodiment of the present invention, it will be seen that the associated safety latch member 190 and overcurrent-protection device d are fundamentally similar to the corresponding elements shown in the embodiment depicted in FIG. 8 but with the exception that the spring 187 of FIG. 8 is of general helical form while the corresponding spring 197 is of leaf-character having a generally downwardly opening U-shaped form with the legs slanting outwardly. Thus, latch member 190 incorporates a groove 191 for accepting the web of spring 197 and the components of overcurrent-protection device d are contoured taperingly downwardly and outwardly from the adjacent spherical recess 195 to provide a resistance surface for the spring legs. Thus leaf spring 197 provides the force through its natural bias for causing overcurrent-protection device d to be urged outwardly for effecting the desired circuit-forming relationship of the components as described in connection with the foregoing embodiments.

Referring now to FIG. 10 which shows a still further embodiment of the present invention, safety latch member 200 incorporates a pair of axially parallel upstanding support legs 204, 205 at the upper ends of each of which there is integrally provided a forwardly projecting rod-like arm 201, 202, respectively, which are free at their outer or forward ends. The overcurrent-protection device e of this embodiment is also of two-part construction with each component e having an opening 203 which extends from front to back thereof and with the outer edges of said components e being contoured for accepting the related fuse element 12'. With the enlarged opening 32 formed in plug body 31 there is centrally provided a forwardly or downwardly extending tapered wall-forming section 206 (see FIG. 10A) which defines with the adjacent portions of plug 31 a pair of compartments for receiving the interengaged portions of latch member 200 and the associated overcurrent-protection device e. In this last connection it will be seen that the arms 201, 202 extend through the opening 203 of the related component e and with there being sufficient "play" so that the component e may be moved freely about its associated arm. With the components e mounted upon their respective latch member arms 201, 202 the composite unit is then inserted within opening 32 and section 206 will project between the components e and by its tapered character exert laterally outwardly directed forces upon said components e to present the related fuse elements 12' in firm conductive relationship with branch contacts 25 of the adjacent prong 21. By reason of the relative length of arms 201, 202 to that of the base portion of latch 200 (see FIG. 10F) said safety latch member may be withdrawn from engagement from components e and then removed from plug opening 32, thereby releasing said components e from the force applied by the taper of section 206. Thereupon dismantling may be easily effected.

Figures 11A, 11B, 11C:
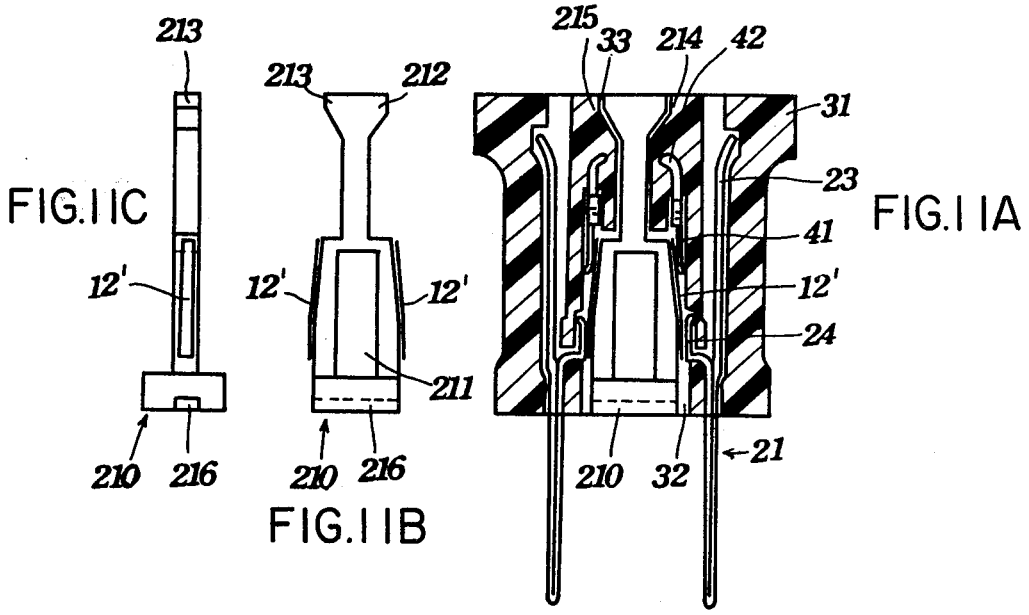
FIGS. 11B and 11C are, respectively, schematic front and side elevational views of the aforesaid safety latch member.

An additional embodiment of the present invention is shown in FIG. 11 wherein the safety latch member 210 upwardly of its base incorporates a vertically extending section having in the lower portion thereof a hollow or opening 211, upon the outer sides of which are suitably attached, as by plating or any other convenient means fuse elements 12'. The said vertical section progresses to an upper end which tapers outwardly being of general fin-shape having flanges 212, 213. Within the lower face of the base of safety latch 210 there is provided a lengthwise extending groove-like recess. Opening 32 of plug body 31 communicates with an opening 33 which is of complementary contour to the upper portion of the vertical section of safety latch member 210; said opening 33 having inclined surfaces 214, 215 for conformingly confronting flanges 212, 213, respectively. When safety latch member 210 is inserted into opening 32 in an orientation as shown in FIG. 11C, fuse elements 12' are not in contact with any conductive element. However, when flanges 212, 213 are brought into confronting relationship with inclined surfaces 214, 215, safety latch member 210 is then turned through an angle of 90°, which causes the opposite ends of each fuse element 12' to be brought into circuit-establishing relationship with prong branch contact 24 and lead terminal 41 under the compressive force developed. Thus, to relieve such force, safety latch member 210 may be rotated through a further angle of 90° and may then easily be removed for replacement, inspection, or repair of the related overcurrent-protection device.

Figure 12B:
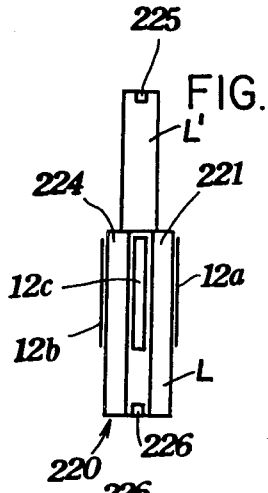
FIGS. 12B and 12C are schematic front elevational and end views, respectively, of the aforesaid latch member.
Figure 12C:
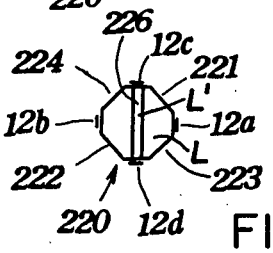
Figure 12A:
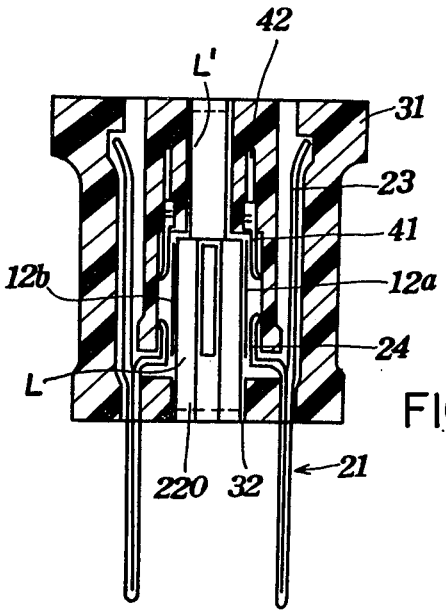
FIG. 12 comprises FIG. 12A which is a vertical transverse sectional view of an electrical plug having an tenth form of safety latch member.
Figure 13B:
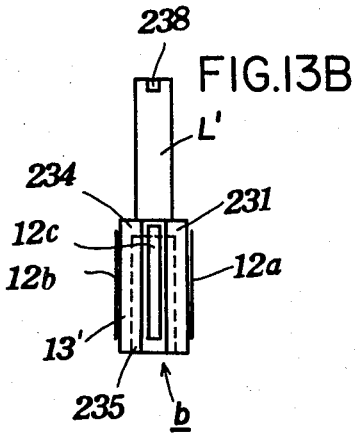
FIGS. 13B and 13C are a schematic elevational view and an end view, respectively, of the aforesaid overcurrent-protection device.
Figure 13A:
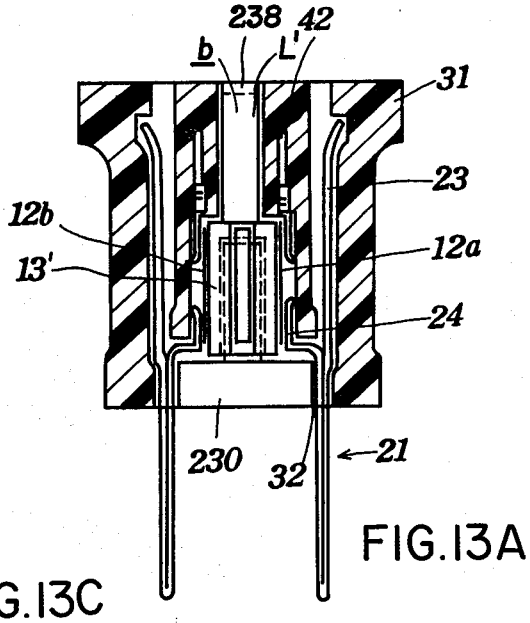
FIG. 13 is a transverse sectional view of an electrical plug having a further form of an overcurrent-protection device and an eleventh form of safety latch member constructed in accordance with and embodying the present invention.
FIG. 13D is a schematic elevational view of the aforesaid safety latch member.
Figure 13C:
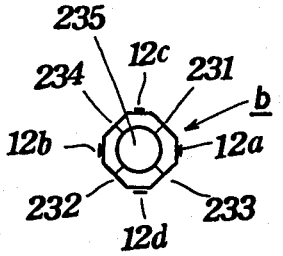
Figure 13D:
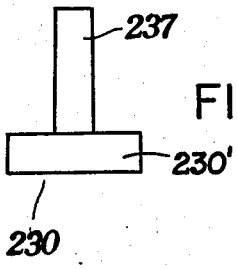

Referring now to FIG. 12, which illustrates an additional embodiment of the present invention, 220 designates the safety latch member which embodies an elongated support leg L of octagonal cross section. Two sets of opposed fuse elements 12*a*, 12*b*, and 12*c*, 12*d* are suitably secured to oppose pairs of sides of said leg L and with the intervening sides 221, 222, 223 and 224 being barren of such elements. It should be recognized however that it is possible to provide a fuse element on each of the eight sides of leg L in order to form four sets of opposite fuse elements for exchange.

Continuous with leg L at its normally upper end is an extension L' which is four sided and relatively narrow, being of markedly reduced cross section with respect to leg L (see FIG. 12C). At the upper end of extension L' and the lower end of leg L there are provided axially parallel outwardly opening grooves 225, 226 for facilitating rotative movement of latch member 200. When said safety latch member 220 is inserted within opening 32 of plug 31 the ends of opposed fuse elements 12A and 12B will be in conductive contacting relation with the branch contacts 24 of the associated prong member 21 and the related lead terminals 41, respectively, under a compressive force. When safety latch member 220 is rotated in either a clockwise or counterclockwise direction, as through an angle of approximately 12½° sides 221, 222 or 223, 224 will thus be brought into confronting relationship with the adjacent branch contacts 24 and thereby break the circuit relationship. Then a further rotation of approximately 12½° will cause the fuse elements 12C, 12D to restore contact with branch contacts 24 and thereby close the circuit. So that by rotating safety latch member 220 through a preselected increment of rotation circuit establishment within plug may be maintained or denied as selected. It will be noted that the overcurrent-protection device of this embodiment can be exchanged for use without removing safety latch member 220 from the body of plug 31. Furthermore, the opposite sides of leg L carry fuse elements having a dimension slightly greater than that of the vacant side surfaces so that when the fuse elements are presented in operative position the compression force developed will be greater than that which is effective when the circuit is open; or in other words when the barren sides are presented to branch contacts 24 there will be no compression force. It should be observed that the rotation of latch member 220 provides the capacity of alteration or orientation can thus endow the same with operability as a switch.

Referring now to FIG. 13 which illustrates an additional embodiment of the present invention, 230 designates a safety latch member which comprehends a base 230' from which centrally upwardly projects a support leg 237. An overcurrent-protection device f is provided which comprises an elongated base portion 13' of octagonal cross section with two sets of opposite fuse elements 12*a*, 12*b* and 12*c*, 12*d* suitably attached to opposite pairs of sides of said base member 13' with the intervening or remaining side faces as at 231, 232, 233 and 234 being bare or vacant. It is, of course, recognized that one might provide a fuse element on each of the eight sides of base member 13' in order to form four pair of related fuse elements for exchange. Base member 13' is provided, in its normally upper portion at the upper end thereof with an extension L' having a recessed transverse groove 238 formed at the end face thereof. Base member 13' is substantially hollow forming a downwardly opening recess 235 and being of complementary contour in cross section to that of leg 237 of latch member 230 for fitted acceptance of the same. Thus, with leg 237 so received within overcurrent-protection device base member 13' the fitted latch member 230 and device f are introduced as a unit within the opening 32 provided in plug 31. It will thus be seen that the relationship of such unit to plug 31 and the effects of rotatability thereof correspond to the related features of the embodiment shown in FIG. 12. However, the present embodiment is capable of providing a relatively enhanced compressive force for assuring of an even more perfect electrical connection. This result may be further improved by causing support leg 237 of latch member 230 to be of tapered contour and thereby through its inherent wedging action to force body of base member 13' of overcurrent-protection device f laterally outwardly into an even tighter contact with the related circuit establishing elements.

Referring now to FIG. 14 which discloses a still further embodiment of the present invention 240 identifies a safety latch member which includes a generally continuous relatively thin side wall 240' of a modified ovate form for developing an enlarged central hollow or open volume 241. Projecting laterally from opposite sides of the normally lower or outer portion of said side wall 240' are opposed downwardly or outwardly projecting flanges 242, 243 which are integrally constructed with laterally outwardly directed flanges 244, 245, respectively; the portion of wall 240' intervening flanges 243, 244 of arcuate form being indicated 246. The opening 32 of plug 31 is provided on its opposite sides with inwardly extending flange or boss portions indicated 247, 248, respectively, and being dimensioned so that when latch member 240 is disposed within said opening 32 the overall width of laterally directed flanges 244, 245 is greater than the distance between the inner edges of plug flanges 247, 248. Fuse elements 12' are suitably affixed to the opposite sides of latch wall 240' immediately upwardly of lateral flanges 244, 245. When latch member 240 together with the fuse elements 12' are inserted into plug opening 32 said flanges 242, 243 are compressed inwardly of plug 31 to cause the intervening arcuate section 246 to present an increased curvature (with an accompanying narrowness, as it were) permitting the laterally directed flanges 244, 245 to pass freely into opening 32 without interference from plug flanges 247, 248. After the latch member 240 with the fuse elements 12' is accepted in opening 32 the compressive force is removed and arcuate wall section 246 is liberated to resume its original shape whereby lateral flanges 244, 245 will be sprung outwardly into engagement upon plug flanges 247, 248 (see FIG. 14A) in which condition the same are thus prevented from inadvertent displacement. The compressive force thus in latch 240 will force fuse elements 12' into circuit-forming relationship with branch contacts 24 and lead terminals 41. Manifestly, when it is desired to replace the overcurrent-protection device the above described operation may be reversed, that is by squeezing laterally inwardly upon latch member 240 so as to permit its facile withdrawal from opening 32.

The advantages of this invention are summarized as follows:

(1) The plug or socket according to the present invention possesses the same functions and advantages of the plug or socket described in pending U.S. application Ser. No. 121,324, which, as stated, is incorporated by reference herein;

(2) The plug or socket according to the present invention provides a consistent, effective electrical connection for assured, reliable performance free from the drawbacks caused by imperfect or incomplete contact;

(3) The plug or socket according to the present invention is unaffected by temperature change;

(4) The plug or socket according to the present invention is not subject to deformation caused by external compression or tension forces;

(5) The plug or socket according to the present invention is not subject to any undesired potential influences inherent in manufacture, such as: deformation, distortion, and the like;

(6) The safety latch member of the present invention can be engaged to the related overcurrent-protection device and thus support the same and the associated fuse elements, which facilitates assembling;

(7) The plug or socket according to the present invention is capable of successfully passing the various rigid tests carrid out by underwriting and testing laboratories, as well as quality control operations of the manufacturing concern;

(8) During the mounting within, and the dismantling from, the plug of overcurrent-protection device, the associated fuse elements are free from damage or breakage;

(9) According to the present invention, the safety latch member or the overcurrent-protection device may be so constructed as to serve also as a switch.

From a study of the various embodiments of the present invention as illustrated in FIGS. 1–14, inclusive, it will be seen that in certain of the embodiments the overcurrent-protection device is of an independent construction and thus adapated for the appropriate interengagement with the related safety latch member. Such overcurrent-protection devices of this character are embodied within the species of the invention as shown particularly in FIGS. 1, 2, 3, 4, 5, 6, 7, 8, 9 and 10; whereas the embodiments depicted in FIGS. 11, 12, 13 and 14 are examples of structures wherein the overcurrent protection device is integrated with the particular latch member.

What is claimed is:

1. In an electrical connection device having an insulating body, a pair of electrical conductors entering said body and terminating in respective connection terminals, a pair of connection electrodes and apertures for connection thereof to a mating device at at least one end of said insulating body, said body further having an outwardly opening chamber between said conductors, overcurrent-protection device means receivable within said chamber and positioned for connecting each of said connection terminals to a corresponding one of said connection electrodes for circuit completion, fuse elements carried on said overcurrent-protection device means, and safety latch means comprising at least one latch member adapted to be removably inserted into said insulating body chamber to maintain said overcurrent-protection device in operative position, the direction of removal of said at least one latch member from said body being the same as the direction in which said connection device is connected to a mating device; the improvement comprising the at least one latch member being adapted to cause opposed portions of said overcurrent-protection device to be forcefully displaced outwardly in opposite directions lateral to the direction of insertion of the latch member into said insulating body chamber by wedging action of the latch member upon said opposed portions during said insertion for establishing circuit-making engagement between the associated fuse elements and the components in said electrical connection device in a positive, reliable manner.

2. In an electrical connection device having an insulating body, a pair of electrical conducts entering said body and terminating in respective connection terminals, a pair of connection electrodes and apertures for connection thereof to a mating device at at least one end of said insulating body, said body further having an outwardly opening chamber between said conductors, overcurrent-protection device means receivable within said chamber and positioned for connecting each of said connection terminals to a corresponding one of said connection electrodes for circuit completion, fuse elements carried on said overcurrent-protection device means, and safety latch means comprising at least one latch member adapted to be removably inserted into said insulating body chamber to maintain said overcurrent-protection device in operative position, the direction of removal of said at least one latch member from said body being the same as the direction in which said connection device is connected to a mating device; the improvement comprising the at least one latch member being adapted to cause opposed portions of said overcurrent-protection device to be forcefully displaced outwardly in opposite directions lateral to the direction of insertion of the latch member into said insulating body chamber by wedging action of the latch member upon said opposed portions during said insertion for establishing circuit-making engagement between the associated fuse elements and the components in said electrical connection device in a positive, reliable manner the safety latch means including laterally projecting flanges and the overcurrent-protection device means comprehending receptacles for said flanges which said receptacles are normally spaced apart a lesser distance than that intervening between said flanges so that upon engagement of said flanges within said receptacles the overcurrent-protection device means are forcefully displaced outwardly for assuring of positive engagement of the associated fuse elements with the components of said device.

3. In an electrical connection device having an insulating body, a pair of electrical conductors entering said body and terminating in respective connection terminals, a pair of connection electrodes and apertures for connection thereof to a mating device at at least one end of said insulating body, said body further having an outwardly opening chamber between said conductors, overcurrent-protection device means receivable within said chamber and positioned for connecting each of said connection terminals to a corresponding one of said connection electrodes for circuit completion, fuse elements carried on said overcurrent-protection device means, and safety latch means comprising at least one latch member adapted to be removably inserted into said insulating body chamber to maintain said overcurrent-protection device in operative position, the direction of removal of said at least one latch member from said body being the same as the direction in which said connection device is connected to a mating device; the improvement comprising the at least one latch member being adapted to cause opposed portions of said overcurrent-protection device to be forcefully displaced outwardly in opposite directions lateral to the direction of insertion of the latch member into said insulating body chamber by wedging action of the latch member upon said opposed portions during said insertion for establishing circuit-making engagement between the associated fuse elements and the components in said electrical connection device in a positive, reliable manner the safety latch means including at least one supporting leg having a normally free upper end and with said leg being tapered inwardly toward said end, said overcurrent-protection device means having a spacing for receiving said leg which spacing is normally of less cross-extent than the maximum tapered portion of said leg so that upon receipt of said leg said overcurrent-protection device means are displaced laterally outwardly under compression force so as to effect positive contact between the associated fuse elements and the components in said device for circuit establishment; said compression force being inoperative upon withdrawal of said latch member to permit said overcurrent-protection device means to return to normal condition.

4. In an electrical connection device having an insulating body, a pair of electrical conductors entering said body and terminating in respective connection terminals, a pair of connection electrodes and apertures for connection thereof to a mating device at at least one end of said insulating body, said body further having an outwardly opening chamber between said conductors, overcurrent-protection device means receivable within said chamber and positioned for connecting each of said connection terminals to a corresponding one of said connection electrodes for circuit completion, fuse elements carried on said overcurrent-protection device means, and safety latch means comprising at least one latch member adapted to be removably inserted into said insulating body chamber to maintain said overcurrent-protection device in operative position, the direction of removal of said at least one latch member from said body being the same as the direction in which said connection device is connected to a mating device; the improvement comprising the at least one latch member being adapted to cause opposed portions of said overcurrent-protection device to be forcefully displaced outwardly in opposite directions lateral to the direction of insertion of the latch member into said insulating body chamber by wedging action of the latch member upon said opposed portions during said insertion for establishing circuit-making engagement between the associated fuse elements and the components in said electrical connection device in a positive, reliable manner said insulating body being provided internally of the chamber thereof with a tapered wall forming portion, said safety latch means having a pair of spaced apart support legs, overcurrent-protection device means being supported upon each leg, said legs having a tapered spacing therebetween of slightly less transverse extent than said tapered wall-forming portion for receiving the latter which forces said legs apart and thence causes the related overcurrent-protection device means to be displaced to cause the associated fuse elements to establish a reliable circuit with the associated components in said electrical connection device.

5. In an electrical connection device having an insulating body, a pair of electrical conductors entering said body and terminating in respective connection terminals, a pair of connection electrodes and apertures for connection thereof to a mating device at at least one end of said insulating body, said body further having an outwardly opening chamber between said conductors, overcurrent-protection device means receivable within said chamber and positioned for connecting each of said connection terminals to a corresponding one of said connection electrodes for circuit completion, fuse elements carried on said overcurrent-protection device means, and safety latch means comprising at least one latch member adapted to be removably inserted into said insulating body chamber to maintain said overcurrent-protection device in operative position, the direction of removal of said at least one latch member from said body being the same as the direction in which said connection device is connected to a mating device; the improvement comprising the at least one latch member being adapted to cause opposed portions of said overcurrent-protection device to be forcefully displaced outwardly in opposite directions lateral to the direction of insertion of the latch member into said insulating body chamber by wedging action of the latch member upon said opposed portions during said insertion for establishing circuit-making engagement between the associated fuse elements and the components in said electrical connection device in a positive, reliable manner the safety latch means comprising a safety latch member having a plurality of spaced apart legs, said overcurrent-protection device means comprising a pair of receptacle-forming members for disposition upon each of said safety latch supporting legs, said supporting legs being upwardly tapered and with the overcurrent-protection devices being internally formed so that the receptacle portions bear such relationship to the taper of the legs that said overcurrent-protection devices are subjected to an outwardly directed force whereby the fuse elements thereof are brought into reliable conductive relation with respect to the associated components of the electrical connection device.

6. In an electrical connection device having an insulating body, a pair of electrical conductors entering said body and terminating in respective connection terminals, a pair of connection electrodes and apertures for connection thereof to a mating device at at least one end of said insulating body, said body further having an outwardly opening chamber between said conductors, overcurrent-protection device means receivable within said chamber and positioned for connecting each of said connection terminals to a corresponding one of said connection electrodes for circuit completion, fuse elements carried on said overcurrent-protection device means, and safety latch means comprising at least one latch member adapted to be removably inserted into said insulating body chamber to maintain said overcurrent-protection device in operative position, the direction of removal of said at least one latch member from said body being the same as the direction in which said connection device is connected to a mating device; the improvement comprising the at least one latch member being adapted to cause opposed portions of said overcurrent-protection device to be forcefully displaced outwardly in opposite directions lateral to the direction of insertion of the latch member into said insulating body chamber by wedging action of the latch member upon said opposed portions during said insertion for establishing circuit-making engagement between the associated fuse elements and the components in said electrical connection device in a positive, reliable manner the latch member embodying an upstanding leg, a spring supported upon said leg for extension beyond the sides thereof, said overcurrent-protection means having a portion for disposition on opposite sides of said leg, each of said portions incorporating means for accepting the adjacent end of said spring whereby under the bias of said spring said overcurrent-protection device means are caused to be displaced laterally outwardly for presenting the associated fuse elements in circuit-forming relationship with the cooperating components in said device.

7. The electrical connection device as defined in claim 6 wherein the spring is of helical form.

8. The electrical connection device as defined in claim 6 wherein the spring is of leaf form.

9. In an electrical connection device having an insulating body, a pair of electrical conductors entering said body and terminating in respective connection terminals, a pair of connection electrodes and apertures for connection thereof to a mating device at at least one end of said insulating body, said body further having an outwardly opening chamber between said conductors, overcurrent-protection device means receivable within said chamber and positioned for connecting each of said connection terminals to a corresponding one of said connection electrodes for circuit completion, fuse elements carried on said overcurrent-protection device means, and safety latch means comprising at least one latch member adapted to be removably inserted into said insulating body chamber to maintain said overcurrent-protection device in operative position, the direction of removal of said at least one latch member from said body being the same as the direction in which said connection device is connected to a mating device; the improvement comprising the at least one latch member being adapted to cause opposed portions of said overcurrent-protection device to be forcefully displaced outwardly in opposite directions lateral to the direction of insertion of the latch member into said insulating body chamber by wedging action of the latch member upon said opposed portions during said insertion for establishing circuit making engagement between the associated fuse elements and the components in said electrical connection device in a positive, reliable manner the safety latch means comprising a latch member of multi-sided form, said overcurrent-protection device means comprising fuse elements mounted upon selected sides of said latch member, means provided in said plug for accepting said latch member with said fuse elements in non-conductive relation to the electrical components of said connection device, and means for rotating said latch member for selectively effecting circuit-producing contact between selected fuse elements carried on said latch member and the cooperating circuit-establishing components of said electrical connection device.

10. The electrical connection device as defined in claim 9 wherein the latch member includes an extension having one or more fin-shaped flanges, said plug body being provided with an opening complementary to said latch member extension and having recesses formed therein for accepting said fin-shaped flanges which provide operative surfaces for facilitating rotation of said latch member to a desired position within said plug body.

11. In an electrical connection device having an insulating body, a pair of electrical conductors entering said body and terminating in respective connection terminals, a pair of connection electrodes and apertures for connection thereof to a mating device at at least one end of said insulating body, said body further having an outwardly opening chamber between said conductors, overcurrent-protection device means receivable within said chamber and positioned for connecting each of said connection terminals to a corresponding one of said connection electrodes for circuit completion, fuse elements carried on said overcurrent-protection device means, and safety latch means comprising at least one latch member adapted to be removably inserted into said insulating body chamber to maintain said overcurrent-protection device in operative position, the direction of removal of said at least one latch member from said body being the same as the direction in which said connection device is connected to a mating device; the improvement comprising the at least one latch member being adapted to cause opposed portions of said overcurrent-protection device to be forcefully displaced outwardly in opposite directions lateral to the direction of insertion of the latch member into said insulating body chamber by wedging action of the latch member upon said opposed portions during said insertion for establishing circuit-making engagement between the associated fuse elements and the components in said electrical connection device in a positive, reliable manner the latch member comprising a body of relatively increased cross section, a plurality of opposite sets of fuse elements of the overcurrent-protection device means being fixed at selected positions upon the exterior of said body for disposition in opposite relation to electrical connection elements within said plug when the latch member is inserted therein whereby said latch member body may be rotated while within said insulating body, and without removal therefrom, to a desired relative position to cause the overcurrent-protection device to be brought into contact with electrical connection elements of said plug body under a compression force, and with further rotation effecting such contact between said electrical connection elements and another set of said fuse elements whereby the replacement of the overcurrent-protection device means may be effected by rotation of the latch member while obviating the necessity of replacing said latch member.

12. In an electrical connection device having an insulating body, a pair of electrical conductors entering said body and terminating in respective connection terminals, a pair of connection electrodes and apertures for connection thereof to a mating device at at least one end of said insulating body, said body further having an outwardly opening chamber between said conductors, overcurrent-protection device means receivable within said chamber and positioned for connecting each of said connection terminals to a corresponding one of said connection electrodes for circuit completion, fuse elements carried on said overcurrent-protection device means, and safety latch means comprising at least one latch member adapted to be removably inserted into said insulating body chamber to maintain said overcurrent-protection device in operative position, the direction of removal of said at least one latch member from said body being the same as the direction in which said connection device is connected to a mating device; the improvement comprising the at least one latch member being adapted to cause opposed portions of said overcurrent-protection device to be forcefully displaced outwardly in opposite directions lateral to the direction of insertion of the latch member into said insulating body chamber by wedging action of the latch member upon said opposed portions during said insertion for establishing circuit-making engagement between the associated fuse elements and the components in said electrical connection device in a positive, reliable manner the latch member comprising a body of relatively increased diameter and having a plurality of circumferentially spaced apart opposed fuse elements with the intervening spacing being vacant; said spacing being thus electrically insulative, means for rotating said latch member within said insulating body so that in one position an opposed pair of fuse elements will be in circuit-forming relationship to the components of said electrical device and in another position said vacant spacing will be in confronting relationship to said electrical components thereby in such state disestablishing the circuit.

13. The electrical connection device as defined in claim 12 wherein the diametrally increased portion of the latch member is of either drum-shape or polyhedral shape.

14. The electrical connection device as defined in claim 12 wherein the diametrally increased portion of the latch member is of either drum-shape or polyhedral shape.

15. The electrical connection device as defined in claim 12 and further characterized by the opposed portions of said latch member having fuse elements attached thereon having a combined transverse thickness slightly greater than that of the adjacent portion having vacant exterior surfaces.

16. The electrical connection device as defined in claim 1 wherein the latch member is provided substantially centrally with a through opening having an edge contour consonant with the configuration of the latch member, said latch member being of resilient construction so that when the same is subjected to a compression force the same will be deformed to enhance the contact between same and the overcurrent-protection device means thereby promoting reliable conductance between the fuse elements and the components in said electrical connection device.

17. The electrical connection device as defined in claim 1 wherein the at least one latch member is provided with a through opening, said latch member having a peripheral length slightly greater than the corresponding length of the opening provided in said insulating body whereby when said latch member is inserted within said opening the same can be productive of a compression force between the overcurrent-protection device means and the components of the electrical connection device.

18. The electrical connection device as defined in claim 1 wherein the safety latch means is fabricated of a resilient material.

19. The electrical connection device as defined in claim 1 wherein the latch member incorporates the base portion of the overcurrent-protection device means, said base member being fabricated of a resilient material.

* * * * *